US010856624B2

(12) United States Patent
Nemecek et al.

(10) Patent No.: US 10,856,624 B2
(45) Date of Patent: Dec. 8, 2020

(54) BUTTON ORNAMENT

(71) Applicant: PUREBUTTONS, LLC, Medina, OH (US)

(72) Inventors: Jeffrey N. Nemecek, Medina, OH (US); Joshua A. Hippley, Akron, OH (US); Mitchell Monyak, Brunswick, OH (US)

(73) Assignee: PUREBUTTONS, LLC, Medina, OH (US)

( * ) Notice: Subject to any disclaimer, the term of this patent is extended or adjusted under 35 U.S.C. 154(b) by 0 days.

(21) Appl. No.: 16/598,463

(22) Filed: Oct. 10, 2019

(65) Prior Publication Data

US 2020/0121030 A1 Apr. 23, 2020

Related U.S. Application Data

(60) Provisional application No. 62/743,872, filed on Oct. 10, 2018.

(51) Int. Cl.
*A44B 1/04* (2006.01)

(52) U.S. Cl.
CPC ..... *A44B 1/04* (2013.01)

(58) Field of Classification Search
CPC ..... A44B 1/04; G09F 21/02; A44C 3/001
See application file for complete search history.

(56) References Cited

U.S. PATENT DOCUMENTS 684,491 A * 10/1901 Adams ..... A44C 3/001 40/1.5
2,067,223 A 1/1937 Janes
2,067,224 A 1/1937 Huckins
2,178,024 A * 10/1939 Pompilio ..... B43M 15/00 40/669
2,336,184 A * 12/1943 Mitchel ..... A44C 3/001 40/1.5
2,338,264 A * 1/1944 Shaw ..... A44C 3/001 40/1.5
3,407,523 A 10/1968 Winston
3,557,478 A * 1/1971 Sitzberger ..... A44C 3/001 40/1.5
3,680,179 A * 8/1972 Saari ..... A44B 1/18 24/106
4,097,971 A * 7/1978 Morris ..... A44C 3/001 24/510
4,597,206 A * 7/1986 Benson ..... A44C 3/001 24/103
4,600,269 A * 7/1986 Rass ..... G02B 5/12 359/519
4,777,744 A * 10/1988 Barnett ..... A44C 3/001 40/1.6
5,067,265 A * 11/1991 Harms ..... A44C 3/001 24/703.1

(Continued)

FOREIGN PATENT DOCUMENTS

GB 2542840 A 4/2017
WO 9635346 A1 11/1996

*Primary Examiner* — Gary C Hoge
(74) *Attorney, Agent, or Firm* — Pearne & Gordon LLP

(57) ABSTRACT

The present disclosure relates to novelty and promotional buttons capable of being hung for display. The button includes an insert with an integral tab having an aperture or a button back with integral tab having an aperture for hanging the button.

19 Claims, 10 Drawing Sheets

(56) References Cited

U.S. PATENT DOCUMENTS

| | | | | |
|---|---|---|---|---|
| 5,355,605 | A * | 10/1994 | Kim | G09F 7/00 101/127.1 |
| 6,269,574 | B1 * | 8/2001 | Sokolofski | G09F 3/12 40/1.5 |
| 6,393,686 | B1 * | 5/2002 | BRaunberger | B21D 53/48 29/509 |
| 10,143,243 | B1 * | 12/2018 | Bardy | A41D 27/08 |
| 2004/0081799 | A1 * | 4/2004 | Kaminsky | G06K 1/121 428/141 |
| 2008/0263916 | A1 * | 10/2008 | Wik | A44C 3/001 40/1.5 |
| 2012/0030978 | A1 | 2/2012 | Miller | |
| 2014/0053435 | A1 * | 2/2014 | Schmitz | A44C 3/001 40/1.5 |
| 2014/0359919 | A1 * | 12/2014 | O'Leary | A41D 27/08 2/244 |
| 2017/0006976 | A1 * | 1/2017 | D'Ercole | F21K 2/06 |

* cited by examiner

BUTTON ORNAMENT

RELATED APPLICATION

This application claims the benefit of U.S. Provisional application No. 62/743,872, filed on Oct. 10, 2018, which is in its entirety incorporated herein by reference.

FIELD OF THE INVENTION

The present disclosure relates to novelty or promotional buttons capable of being fastened to or hung on an object. The button includes an insert that includes an integral tab with an aperture.

BACKGROUND

Novelty and promotional buttons with text and/or graphics are widely used for promotional purposes. Conventional buttons include a front plate made of metal or plastic and a button back that are secured at the rear of the front plate. The text and/or graphics are engraved or printed on the front plate or are printed onto a sheet that overlies or is laminated to the front plate. Optionally, a transparent film or sheet is placed over the text and/or graphics. Edges of the front plate are usually folded back to form a circumferential rim that can be crimped over the button back to secure it in place or crimped in such a way to secure an insert in place.

SUMMARY

In a first aspect, disclosed is a button. The button includes a front plate having a circumferential rim and a recess disposed at a rear surface thereof; an insert positioned within the recess, the insert comprising a horizontal projection and a vertically-extending projection; and a tab that is integral to and extends from the insert.

In a second aspect, disclosed is a button. The button includes a front plate having a circumferential rim and a recess disposed at a rear surface thereof; a button back comprising an opening that extends from a front surface thereof to a rear surface thereof; and a tab integral to the button back.

DETAILED DESCRIPTION

Herein, when a range such as 5-25 (or 5 to 25) is given, this means preferably at least 5 and, separately and independently, preferably not more than 25.

Figure 1:
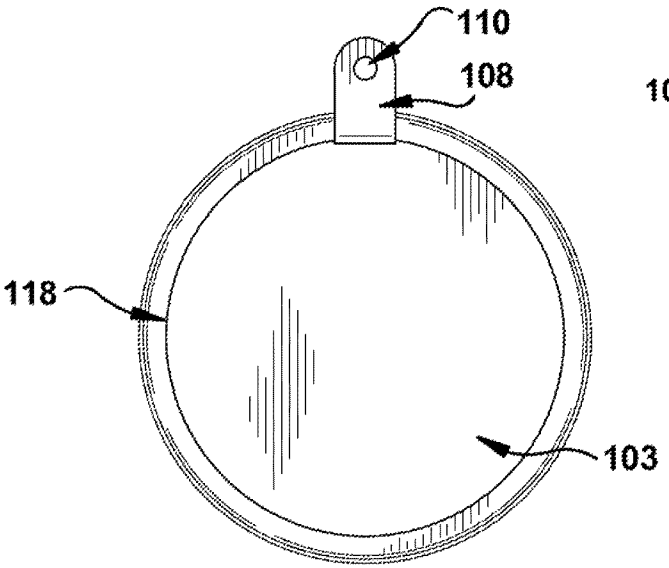
FIG. 1 is a rear view of a button with an extended tab.
Figure 4:
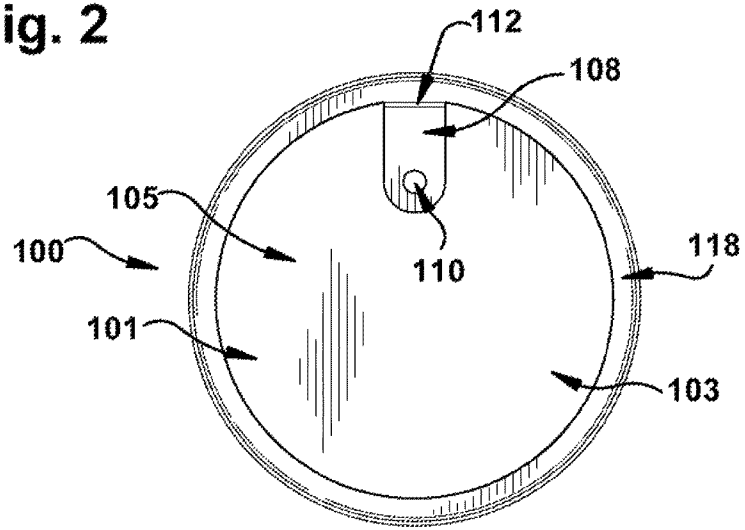
FIG. 4 is a rear view of the button of FIG. 3.
Figure 7:
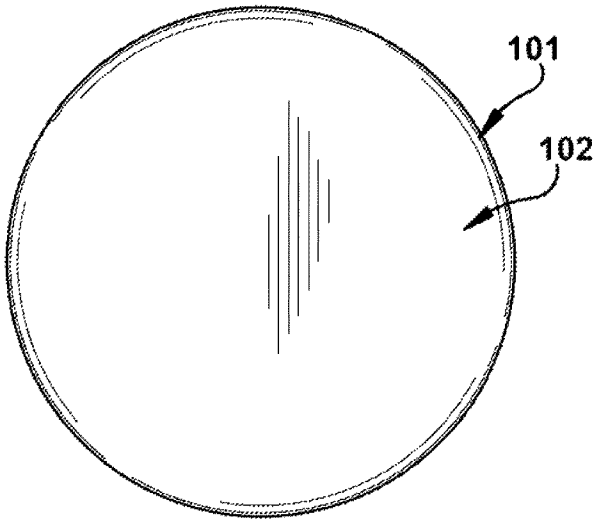
FIG. 7 is a front view of a button without text, graphics, or a graphic layer.

FIGS. 1 and 4 illustrate a rear view of a button 100. The button 100 includes a plate 101 that includes a front surface 102 (shown in FIG. 7), a rear surface 103, a circumferential rim 104 (shown in FIG. 8) that extends rearward and defines a recess 105 formed at the rear surface 103 of the plate 101. A circular insert 118 with an integral tab 108 is positioned within the recess 105. The tab 108 includes an aperture 110.

Figure 5:
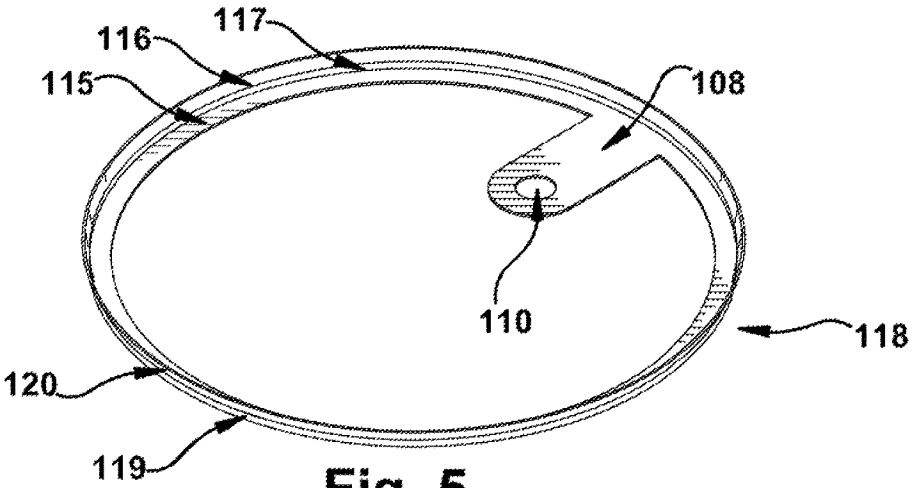
FIG. 5 is a rear perspective view of a circular insert with an integral tab.

FIG. 5 illustrates a perspective view of a back face of one embodiment of the circular insert 118. In other embodiments, the insert 118 can be any shape that is complimentary to the shape of the button 100 and/or the rim 104, such as square, rectangular, triangular, etc. The tab 108 is integral to the insert 118 such that the tab 108 and the insert 118 are made of a single piece of material, such as metal or plastic. In this embodiment, the insert 118 includes a horizontal projection 115 and a vertically-extending projection 116 that create an angle, such as an L-shape, at the point of intersection 117. The horizontal projection 115 is flush with the rear edge of the circumferential rim 104. In one example shown in FIG. 5, the vertically-extending projection 116 includes a linear segment 119 that intersects the horizontal projection 115 at a 90° angle, and an angled segment 120 that is directed at an angle from the linear segment 119.

Figure 6:
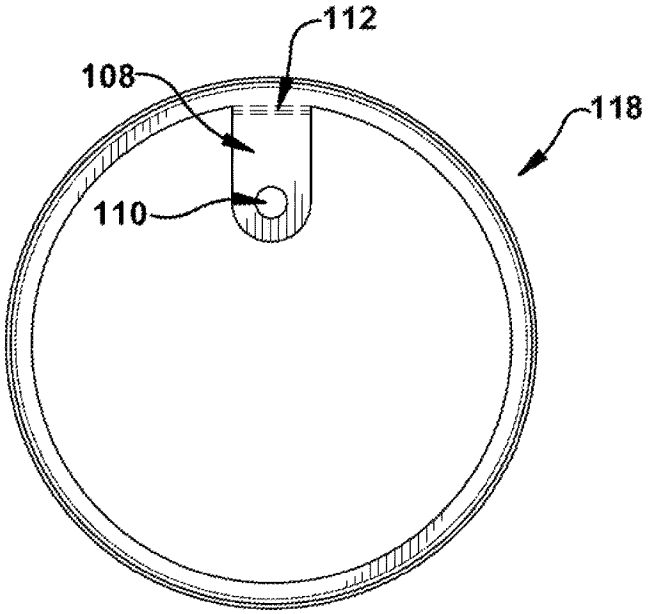
FIG. 6 is a front view of the insert of FIG. 5 with a score at the point of intersection of the tab and insert.
Figure 10:
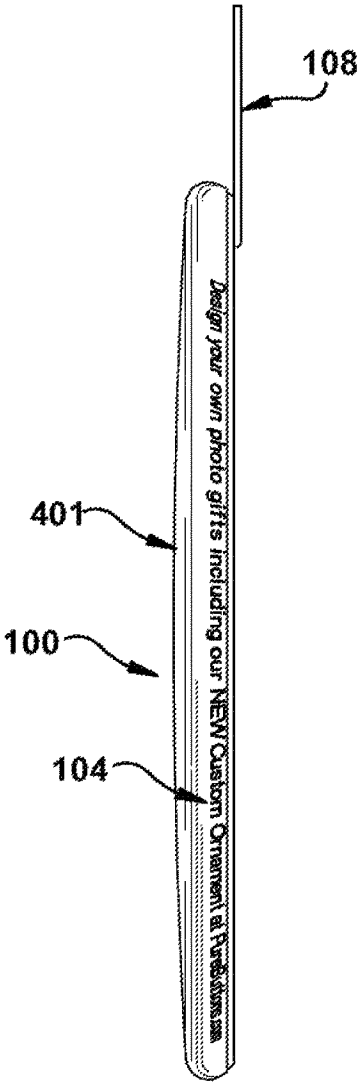
FIG. 10 is a side view of the button of FIG. 1.
Figure 9:
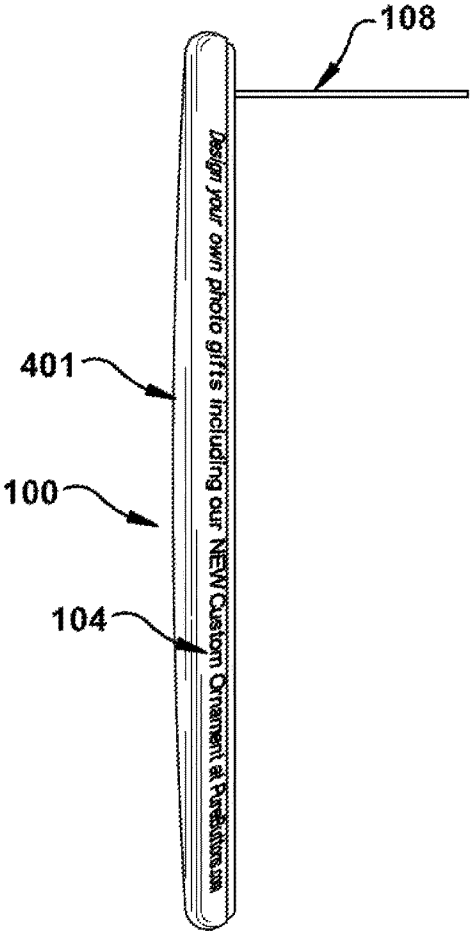
FIG. 9 is a side view of a button with a partially extended tab.
Figure 8:
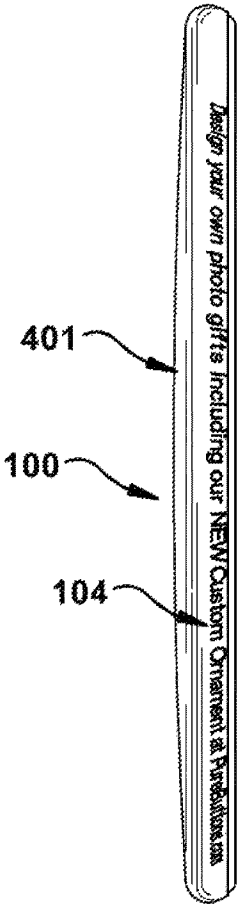
FIG. 8 is a side view of the button of FIG. 3.

FIG. 6 shows a front view of the insert 118 with a score 112 at the intersection between the tab 108 and the insert 118. The score 112 can facilitate movement of the tab 108 to extend the tab 108 beyond the diameter of the button 100, as opposed to radially inward from the rim 104. For example, FIG. 8 shows a side view of the button 100 with the tab 108 in a first position, while FIG. 9 shows the tab 108 partially extended away from the rear surface 103 of the plate 101 in a second position. FIG. 10 shows the tab 108 extended in a third position that is parallel with the button, or approximately 180° from the first position. The tab 108 can be retained in a position more or less than 180° based on the malleability of material used to prepare the insert 118 and tab 108. In some embodiments, the score 112 extends the entire width of the tab 108. In other embodiments, the score 112 extends along a portion of the width of the tab 108 or intermittently extends along the width of the tab 108. Other embodiments may not include a score 112. In yet other embodiments, the tab 108 includes more than one score at different location along the tab 108. For example, other embodiments may include 2, 3, or 4 scores 112. In yet another embodiment, the tab 108 is in the extended position but is not foldable. In this embodiment, the tab 108 extends from the outer circumference of the insert 118 but does not include a score at the junction of the tab 108 and the insert 118.

Figure 21:
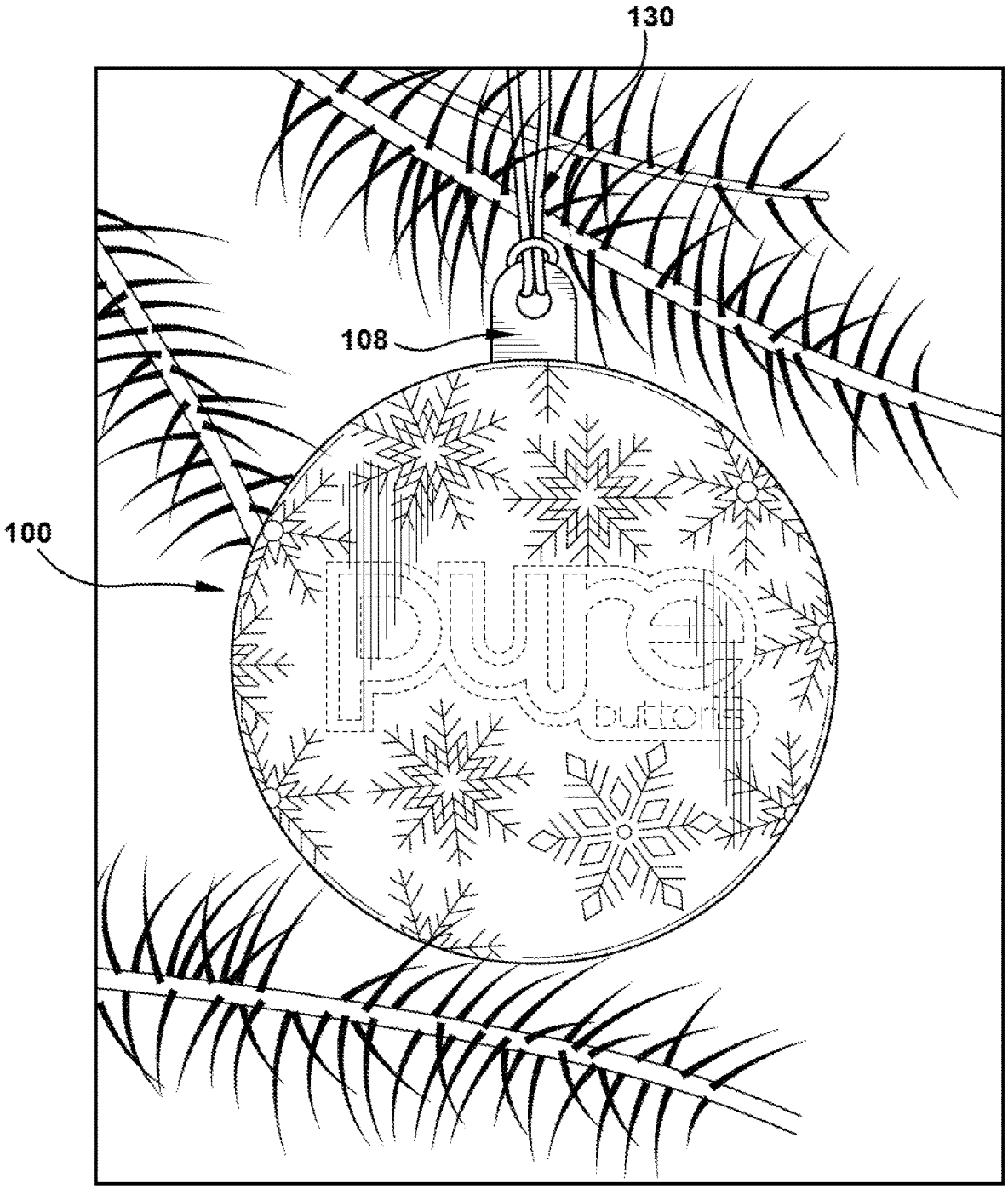
FIG. 21 is a front view of the button of FIG. 3 with an extended tab and attachment means.
Figure 23:
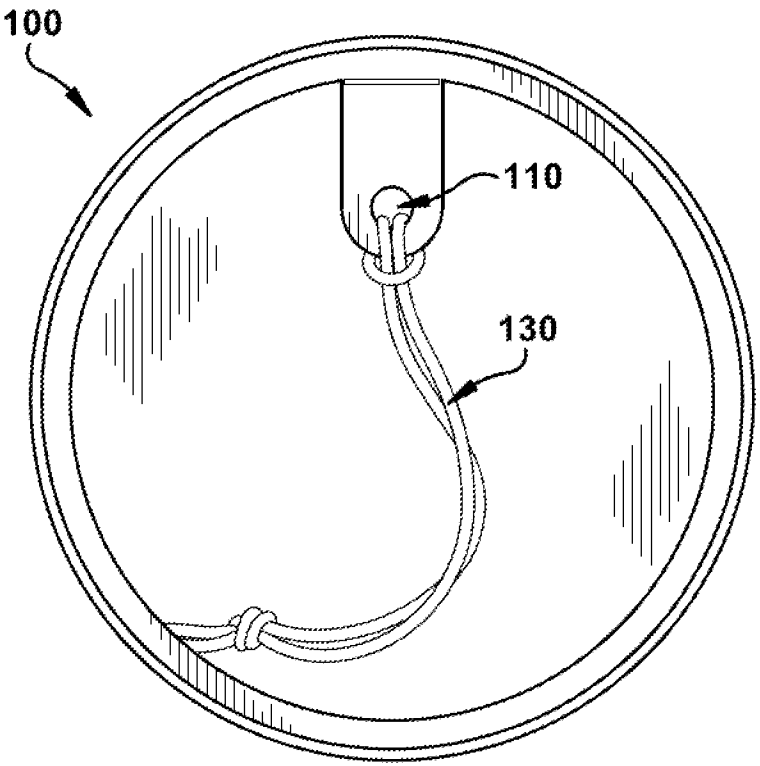
FIG. 23 is a back view of the button of FIG. 3 with an attachment means.
Figure 22:
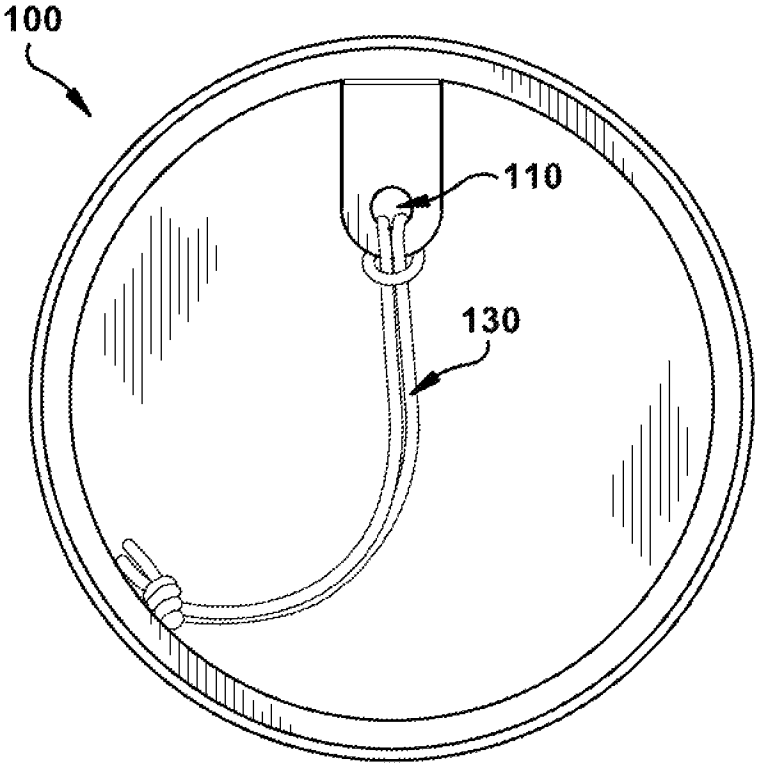
FIG. 22 is a back view of the button of FIG. 3 with an attachment means.

As shown in FIGS. 22 and 23, the aperture 110 can be used to attach the button 100 with attachment means 130, such as thread, rope, string, cord, wire, or hook. The aperture 110 may be circular, triangular, rectangular, or any other shape suitable for receiving the attachment means. FIG. 21 shows a button 100 with a tab 108 in an extended position and an attachment means 130.

Typically, the insert 118 has an overall lateral dimension that is smaller than the corresponding dimension of the plate 101. This allows the insert 118 to be received in the recess 105 defined at the rear of the plate 101 and to be crimped by the circumferential rim 304 thereof. The lateral dimension of the linear segment 119 measures from 65 mm to 105 mm, preferably from 75 mm to 95 mm, more preferably from 80 mm to 90 mm, and most preferably from 83 mm to 85 mm. The lateral dimension of the angled segment 120 measures from 65 mm to 105 mm, preferably from 75 mm to 95 mm, more preferably from 80 mm to 90 mm, and most preferably from 84 mm to 86 mm. The angled segment 120 has an angle of from 0° to 90°, preferably from 5° to 45°, more preferably from 10° to 25°, and most preferably from 18° to 20° relative to the linear segment 119. The longitudinal dimension of the insert 118 measures from 1 mm to 5 mm, preferably from 1.5 mm to 4 mm, more preferably from 2 mm to 3 mm, and most preferably from 2.5 mm to 2.9 mm. The longitudinal dimension of the linear segment 119 measures from 0.1 mm to 5 mm, preferably from 0.5 mm to 3 mm, more preferably from 0.9 to 2 mm, and most preferably from 1.1 to 1.3 mm. The lateral dimension (i.e. diameter when button back 201 is circular) of the aperture 110 measures from 1 mm to 10 mm, preferably from 2 mm to 8 mm, more preferably from 3 mm to 7 mm, and most preferably from 4 mm to 6 mm. The lateral dimension of the tab 108 measures from 5 mm to 20 mm, preferably from 8 mm to 17 mm, more preferably from 11 to 14 mm, and most preferably from 12 mm to 13 mm. The distance from the middle of the insert 118 to the middle of the aperture 110 measures from 15 mm to 45 mm, preferably from 20 mm to 40 mm, more preferably from 25 mm to 30 mm, and most preferably from 28 mm to 30 mm.

Figure 12:
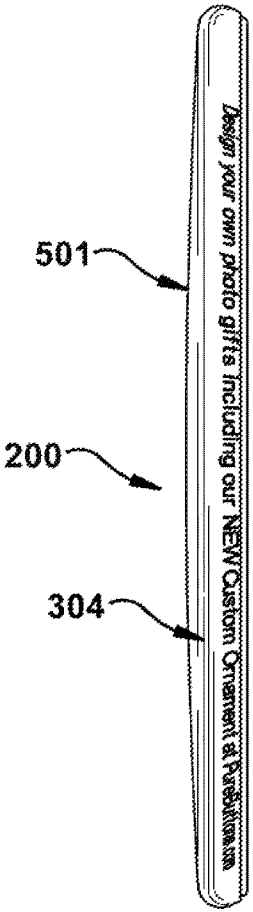
FIG. 12 is a side view of a button with a button back.
Figure 11A:
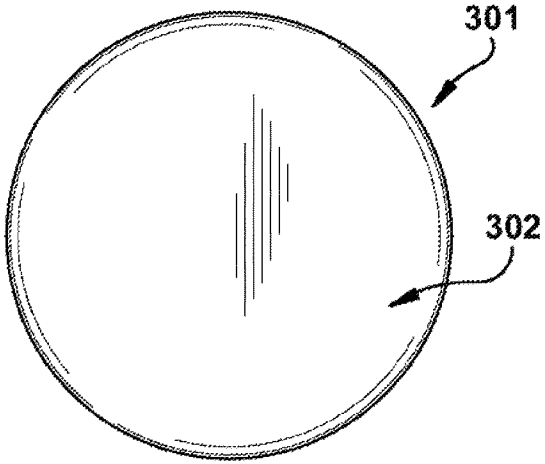
FIG. 11A is a front view of a button.
Figure 11B:
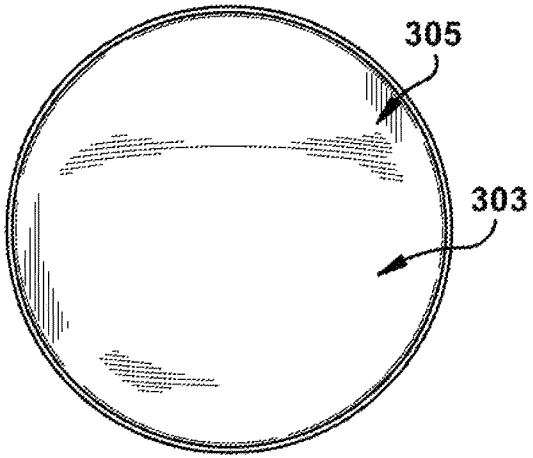
FIG. 11B is a back view of the button of FIG. 11A.

In another embodiment shown in FIGS. 11A, 11B and 12, a button 200 includes a front plate 301 with a front surface 302, a rear surface 303, a circumferential rim 304 that extends rearward and defines a recess 305 formed at the rear surface of the plate 301, and a button back 201 (shown in FIGS. 14-20). The button back 201 includes a front surface 202 (shown in FIGS. 19 and 20) and a rear surface 203 (shown in FIGS. 17 and 18). In one embodiment, the button back 201 is disposed in the recess of the plate 301, wherein the button back front surface 202 is arranged flush with the rear edge of the circumferential rim 304. Once the button back 201 is arranged in this manner, the circumferential rim 304 may be crimped over the perimeter edge of the button back 201 to secure the button back 201 within the recess 305 of the plate 301. The button back 201 may be prepared from a paper, plastic, or metal.

Figure 13:
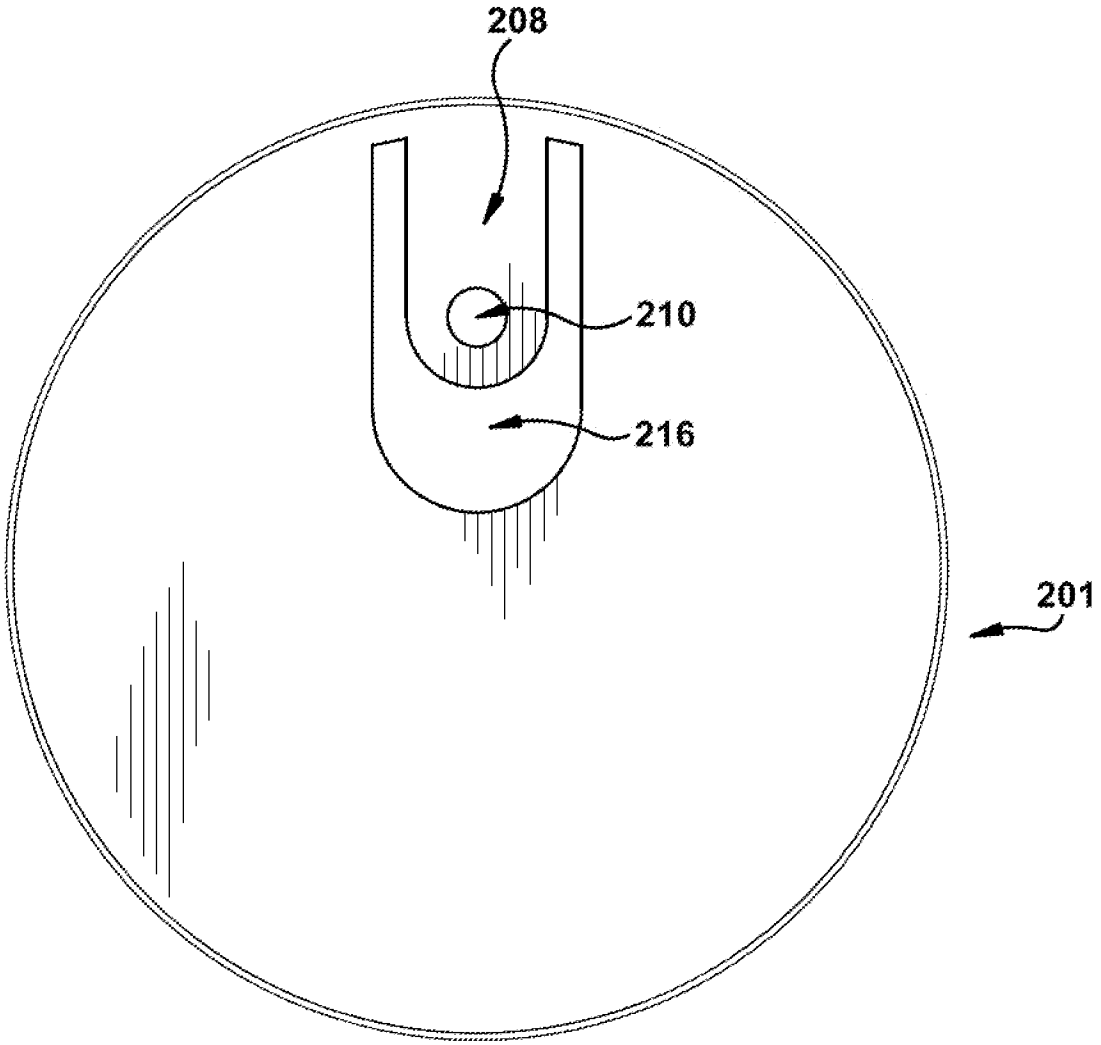
FIG. 13 is a front view of a button back.

As shown in FIG. 13, the button back 201 includes an integral tab 208 that can pivot or extend outward from the button back rear surface 203 to assist in fastening or hanging the button 200 to or on an object. The tab 208 is positioned within a cutout 216 of the button back 201. The cutout 216 surrounds a majority, but not all, of the tab 208, so that the tab 208 remains connected to the button back 201. Further, the tab 208 includes an aperture 210 that is capable of receiving attachment means, such as a thread, rope, string, cord, wire, or hook. The aperture 210 may be a circular, triangular, rectangular, or any other shape suitable for receiving the attachment means.

Figure 14:
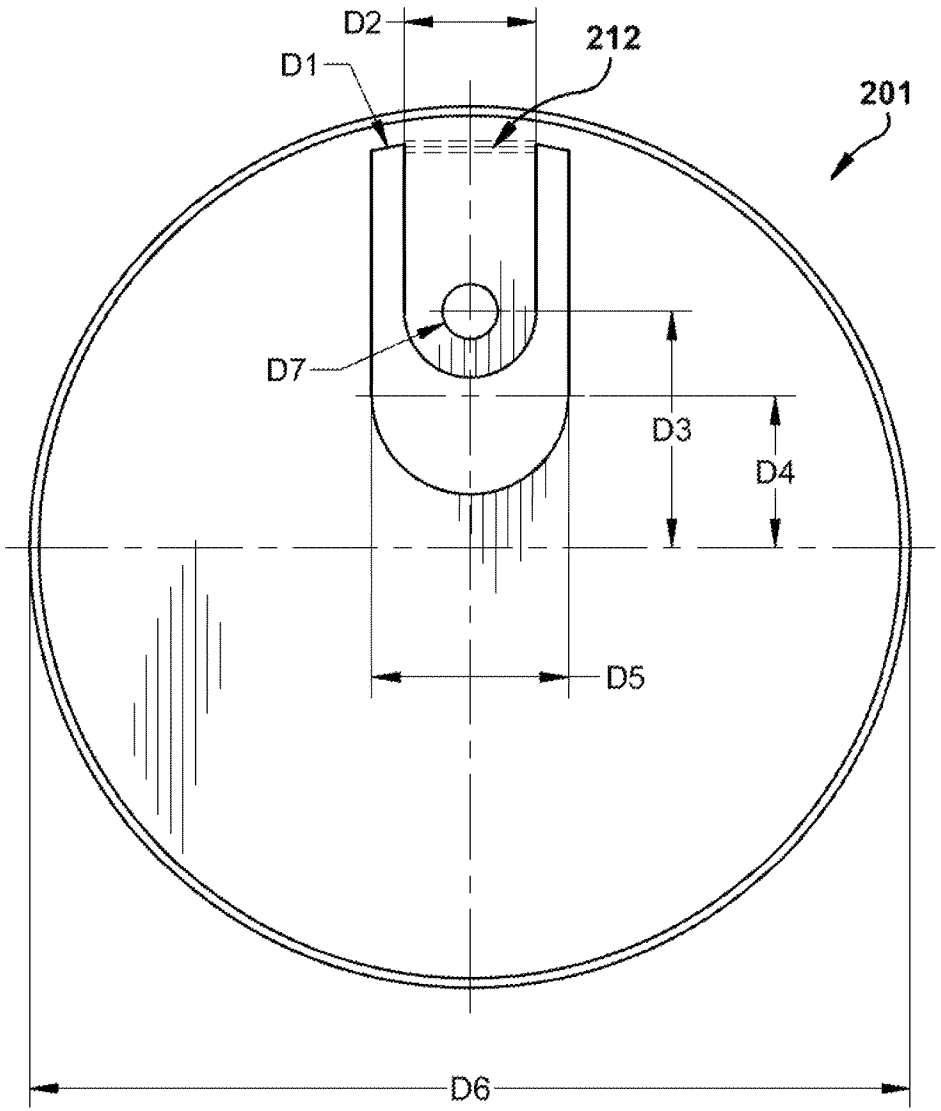
FIG. 14 is a front view of a button back with a score.
Figure 19:
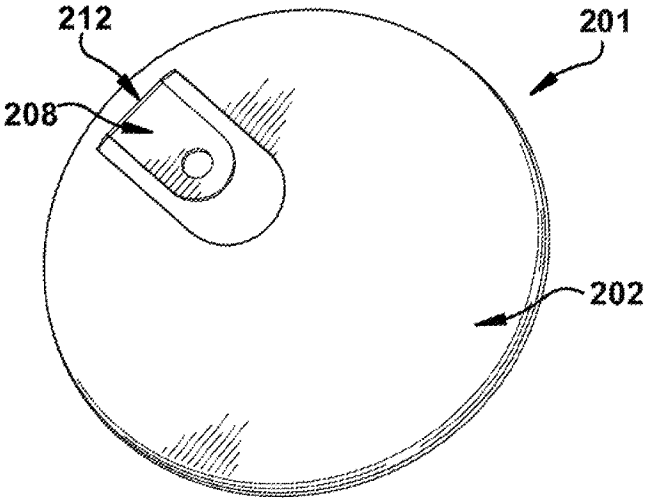
FIG. 19 is a front perspective view of the button back of FIG. 14.

FIGS. 14 and 19 show a front view of the button back 201 with a score 212 at the intersection between the tab 208 and the button back 201. The score 212 can facilitate movement of the tab 208 to extend the tab 208 beyond the diameter of the button 200, as opposed to radially inward from the rim 304. The tab 208 can be retained in a position more or less than 180° based on the malleability of material used to prepare the button back 201 and tab 208. In some embodiments, the score 212 extends the entire width of the tab 208. In other embodiments, the score 212 extends along a portion of the width of the tab 208 or intermittently extends along the width of the tab 208. Other embodiments may not include a score 212. In yet other embodiments, the tab 208 includes more than one score at different location along the tab 208. For example, other embodiments may include 2, 3, or 4 scores 212. In yet another embodiment, the tab 208 is in the extended position but is not foldable. In this embodiment, the tab 208 extends from the outer circumference of the insert 118 but does not include a score at the junction of the tab 108 and the insert 118.

Typically the button back 201 has an overall lateral dimension that is smaller than the corresponding dimension of the front plate 301. This allows the button back 201 to be received in the recess 305 defined at the rear of the front plate 301 and to be crimped by the circumferential rim 304 thereof. Shown in FIGS. 15, 16A, and 16B, the button back 201 includes a vertically-extending projection 217. In one example shown in FIG. 16B, the vertically-extending projection 217 includes a linear segment 219 that intersects the rear surface 203 at a 90° angle, and an angled segment 220 that is directed at an angle from the linear segment 219.

Figure 15:
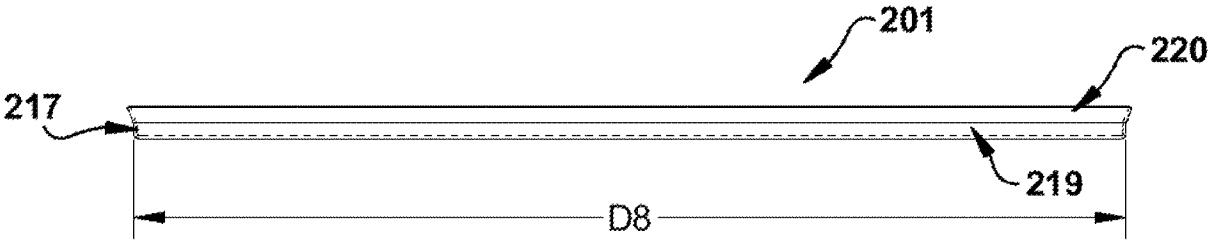
FIG. 15 is a side view of the button back of FIG. 14.

FIG. 14 shows a front view of a button back 201. In one embodiment, D1 is the furthest point of the cutout from the center of the button which measures from 37 mm to 40.5 mm, preferably from 37.5 mm to 40 mm, more preferably from 38 mm to 39.5 mm, and most preferably from 38.5 mm to 39 mm. The lateral dimension D2 of the tab 208 measures from 5 mm to 20 mm, preferably from 8 mm to 17 mm, more preferably from 11 to 14 mm, and most preferably from 12 mm to 13 mm. The distance D3 from the middle of the button back 201 to the middle of the aperture 210 measures from 10 mm to 35 mm, preferably from 15 mm to 30 mm, more preferably from 20 mm to 25 mm, and most preferably from 22 mm and 23 mm. The distance D4 between the middle of the button back 201 and the bottom of the tab 208 measures from 5 mm to 25 mm, preferably from 10 mm to 20 mm, more preferably from 12 mm to 18 mm, and most preferably from 14 mm to 15 mm. The lateral dimension D5 of the cutout 216 measures between 10 mm and 30 mm, preferably from 14 mm to 25 mm, more preferably from 16 mm to 20 mm, and most preferably from 18 mm to 19 mm. The lateral dimension D6 of the button back 201 measures from 65 mm to 105 mm, preferably from 75 mm to 95 mm, more preferably from 80 mm to 90 mm, and most preferably from 84 mm to 86 mm. The lateral dimension D7 of the aperture 210 measures from 1 mm to 10 mm, preferably from 2 mm to 8 mm, more preferably from 3 mm to 7 mm, and most preferably from 4 mm to 6 mm. FIG. 15 shows a side view of the button back 201. The lateral dimension D8 of the button back 201 from the linear segment 219 measures from 65 mm to 105 mm, preferably from 75 mm to 95 mm, more preferably from 80 mm to 90 mm, and most preferably from 83 mm to 85 mm.

Figure 16A:
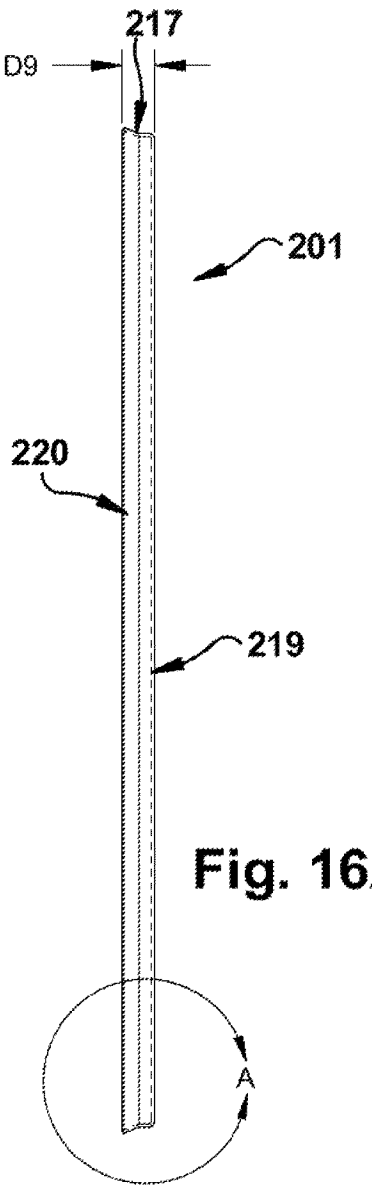
FIG. 16A is a side view of the button back of FIG. 14.
Figure 16B:
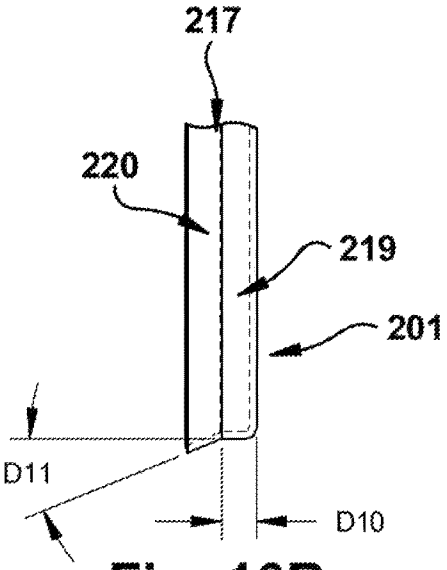
FIG. 16B is a side view of the section A of FIG. 16A.
Figure 18:
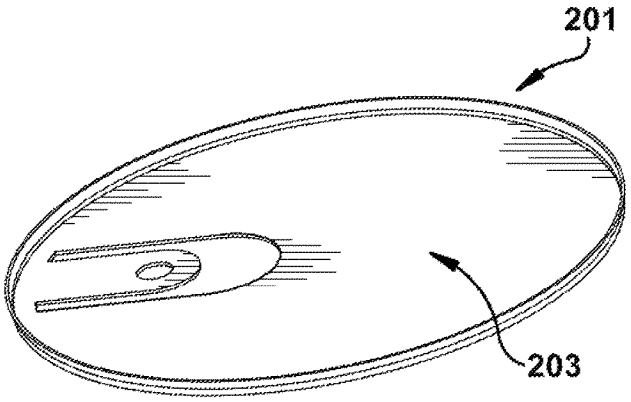
FIG. 18 is a back perspective view of the button back of FIG. 14.
Figure 20:
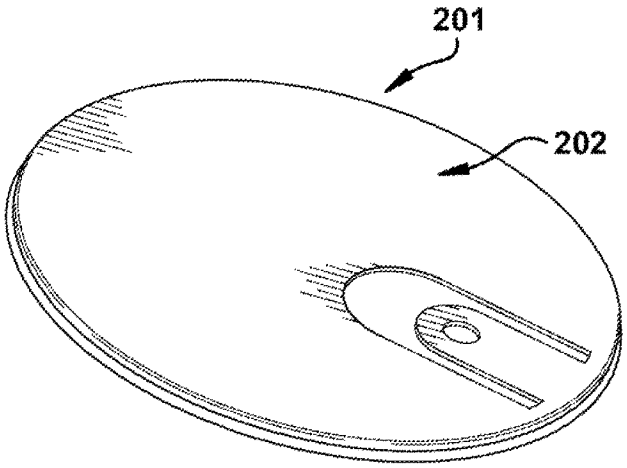
FIG. 20 is a front perspective view of the button back of FIG. 14.
Figure 17:
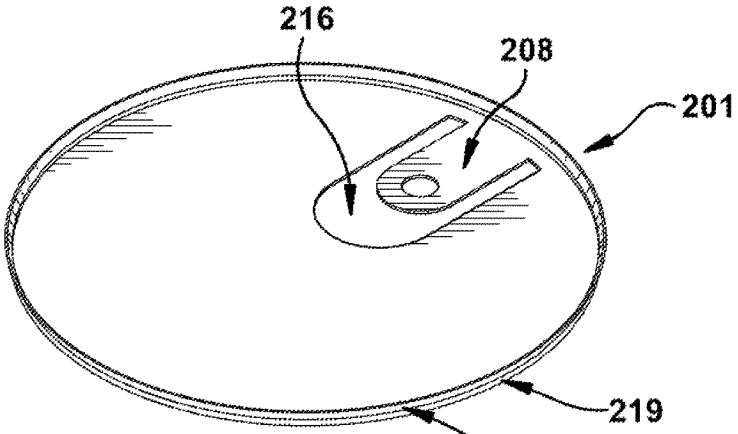
FIG. 17 is a back perspective view of the button back of FIG. 14.

FIGS. 16A and 16B show a side view of the button back 201. The longitudinal dimension D9 of the button back 201 measures from 1 mm to 5 mm, preferably from 1.5 mm to 4 mm, more preferably from 2 mm to 3 mm, and most preferably from 2.5 mm to 2.9 mm. The longitudinal dimension D10 of the linear segment 219 measures from 0.1 mm to 5 mm, preferably from 0.5 mm to 3 mm, more preferably from 0.9 to 2 mm, and most preferably from 1.1 to 1.3 mm. The angled segment D11 has an angle of from 0° to 90°, preferably from 5° to 45°, more preferably from 10° to 25°, and most preferably from 18° to 20° relative to the linear segment.

The plate 101, 301 may be substantially flat or slightly domed. The plate 101, 301 includes front surfaces 102, 302, rear surfaces 103, 303, and a circumferential rim 104, 304 that extends rearward and defines a recess 105, 305 formed at the rear surface 103, 303 of the plate 101, 301. The plate 101, 301 may be prepared from paper, plastic, or metal, including ferrous and non-ferrous metals. In one embodiment the plate 101, 301 is stamped from sheet metal. In another embodiment the plate 101, 301 is injection molded from plastic.

Figure 2:
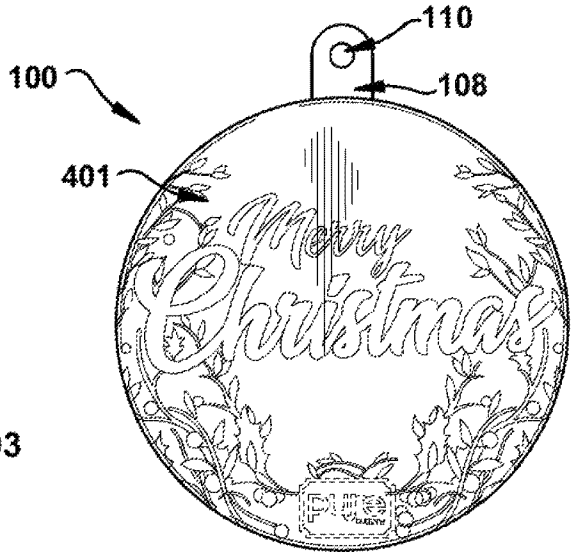
FIG. 2 is a front view of the button of FIG. 1 with a graphic layer.
Figure 3:
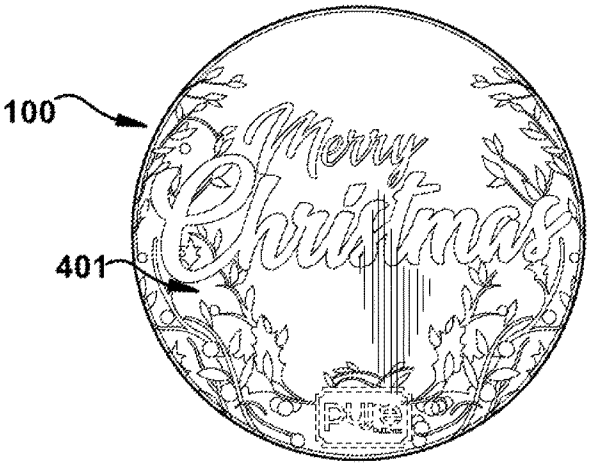
FIG. 3 is a front view of a button with a non-extended tab and graphic layer.

Text and/or graphics may be engraved or printed on the plate front surface 102, 302. As illustrated in FIGS. 2, 3, and 12, the plate 101, 301 can also support supports a graphic layer 401, 501 (such as printed paper or plastic) that includes the text and/or graphics for display. The button 100, 200 can include a transparent film (not shown) to protect the text and/or graphics. The transparent film (when present) is disposed over (e.g. laminated to) the graphic layer 401, 501 or the plate front surface 102, 302. In another embodiment, both sides of the graphic layer 401, 501 are laminated with a transparent film. The transparent film is made from a conventional clear plastic material.

Optionally, the button 100, 200 includes a textured, soft-touch matte finish, such as that of velvet or suede, on the plate front surface 102, 302 through which indicia printed or applied thereon is visible. In another embodiment, the button 100, 200 includes a textured, soft-touch matte finish on the graphic layer 401, 501.

Optionally, the button 100, 200 includes a glossy finish on the plate front surface 102, 302 through which indicia printed or applied thereon is visible. In another embodiment, the button 100, 200 includes a glossy finish on the graphic layer 401, 501.

Once the individual components are assembled, they are inserted into a crimping press where they are pressed together with the plate 101, optional graphic layer 401 and transparent layer overwrapping the circumferential rim 104, and the insert 118. In an alternative embodiment, once the individual components are assembled, they are inserted into a crimping press where they are pressed together with the plate 301, optional graphic layer 501 and transparent layer overwrapping the circumferential rim 304, and the button back 201.

Although the illustrated embodiments show circular buttons, the novelty and promotional buttons may be in any shape, including triangles, quadrilaterals, polygons, ellipses, and crescents. In desirable embodiments the button 100, 200 is a novelty item having a diameter of approximately three inches, less preferably a diameter of approximately two to four inches, even less preferably a diameter of approximately one to six inches. However, other dimensions and diameters can be used.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the claims.

The invention claimed is:

1. A button comprising:

a front plate having a circumferential rim and a recess disposed at a rear surface thereof;

an insert positioned within the recess, the insert comprising a horizontal projection and a vertically-extending projection; and a tab that is integral to and extends from the insert, wherein the tab comprises an aperture.

2. The button of claim 1, wherein the tab extends from the horizontal projection.

3. The button of claim 1, further comprising a score at a point of intersection between the insert and the tab.

4. The button of claim 1, wherein the vertically-extending projection is in direct contact with the rear surface.

5. The button of claim 1, further comprising a textured, soft-touch matte finish on a front surface of the plate through which indicia printed or applied thereon is visible.

6. The button of claim 1, further comprising a textured, soft-touch matte finish being applied via a label overlaid on a front surface of the plate.

7. The button of claim 1, further comprising a glossy finish on a front surface of the plate through which indicia printed or applied thereon is visible.

8. The button of claim 1, further comprising a glossy finish being applied via a label overlaid on a front surface of the plate.

9. A button comprising:

a front plate having a circumferential rim and a recess disposed at a rear surface thereof;

a button back comprising an opening that extends from a front surface thereof to a rear surface thereof; and a tab integral to the button back, wherein the tab comprises an aperture.

10. The button of claim 9, further comprising a score at a point of intersection between the button back and the tab.

11. The button of claim 9, the button back further comprising a vertically-extending projection in direct contact with the rear surface.

12. The button of claim 9, wherein the circumferential rim is crimped over a perimeter edge of said button back.

13. The button of claim 9, further comprising a textured, soft-touch matte finish on a front surface of the plate through which indicia printed or applied thereon is visible.

14. The button of claim 9, further comprising a textured, soft-touch matte finish being applied via a label overlaid on a front surface of the plate.

15. The button of claim 9, further comprising a glossy finish on a front surface of the plate through which indicia printed or applied thereon is visible.

16. The button of claim 9, further comprising a glossy finish being applied via a label overlaid on a front surface of the plate.

17. The button of claim 9, wherein a diameter of the plate being greater than a diameter of the button back.

18. A button comprising:

a front plate having a circumferential rim and a recess disposed at a rear surface thereof;

an insert positioned within the recess, the insert comprising a horizontal projection and a vertically-extending projection;

a tab that is integral to and extends from the insert; and a score at a point of intersection between the insert and the tab.

19. A button comprising:

a front plate having a circumferential rim and a recess disposed at a rear surface thereof;

a button back comprising an opening that extends from a front surface thereof to a rear surface thereof;

a tab integral to the button back; and a score at a point of intersection between the button back and the tab.

* * * * *